United States Patent [19]

Birkle et al.

[11] 4,399,018

[45] Aug. 16, 1983

[54] DEVICE FOR ELECTRODEPOSITION OF ALUMINUM

[75] Inventors: Siegfried Birkle, Hoechstadt; Johann Gehring, Spardorf; Klaus Stoeger, Nuremberg, all of Fed. Rep. of Germany

[73] Assignee: Siemens Aktiengesellschaft, Berlin & Munich, Fed. Rep. of Germany

[21] Appl. No.: 393,199

[22] Filed: Jun. 28, 1982

[30] Foreign Application Priority Data

Aug. 21, 1981 [DE] Fed. Rep. of Germany ..... 3133232

[51] Int. Cl.[3] ..... C25D 17/06

[52] U.S. Cl. ..... 204/199; 204/200

[58] Field of Search ..... 204/199, 200, 201, 277, 204/278

[56] References Cited

U.S. PATENT DOCUMENTS 4,176,034 11/1979 Stoger ..... 204/199
4,265,726 5/1981 Herrnring et al. .
4,363,712 12/1982 Birkle ..... 204/199

FOREIGN PATENT DOCUMENTS 2901586 7/1980 Fed. Rep. of Germany .
3044975 6/1982 Fed. Rep. of Germany .

*Primary Examiner*—T. M. Tufariello
*Attorney, Agent, or Firm*—Hill, Van Santen, Steadman & Simpson

[57] ABSTRACT

A device for electrodepositing aluminum from an aprotic oxygen-free and water-free aluminum-organic electrolyte which comprises an annular electroplating tank which is subdivided into concentric sub-cells with each cell having electrolyte and anode plates. To charge and discharge workpiece holders into and out of the device includes a charging lock and also a separate discharging lock.

11 Claims, 24 Drawing Figures

8

DEVICE FOR ELECTRODEPOSITION OF ALUMINUM

BACKGROUND OF THE INVENTION

The present invention is directed to a device for the electrodeposition of aluminum from an aprotic, oxygen-free and water-free aluminum-organic electrolyte. The device comprises an annular electroplating tank which comprises an annular vat filled with the electrolyte and anode plates and covered by a hood to provide a protective atmosphere that is isolated from the outside. To support and move workpiece holders through the annular vat, the tank includes a rotatable support rack having brackets extending radially from a vertical axle and having receptacles for receiving the workpiece holder to suspend the workpiece holder in the vat for rotation on the curve. The tank also includes a charging lock and a discharging lock so that the brackets can be loaded and unloaded without contaminating the atmosphere and the electrolyte of the tank.

A device for electrodepositing of aluminum from an aprotic, oxygen-free, water-free aluminum-organic electrolyte, which device has a lock system with a liquid lock for introduction and removal of the goods to be electroplated is disclosed in U.S. Pat. No. 4,265,726 which was based on German OS No. 2,901,586. In the device of this patent, the goods, which are to be electroplated, are accommodated on workpiece supports or workpiece holders which can be introduced with the assistance of an endless conveyor belt from an antechamber floodable with an inert gas through a liquid lock and into an electroplating bath or vat. After the electroplating has been accomplished, the holder is again transferred in the reverse direction with the assistance of the same conveyor belts. A disadvantage of this known device is that a rather considerable amount of the electrolyte is entrained from the electrolyte vat or bath into the liquid lock. Due to this continuing contamination of the liquid forming the liquid lock with the electrolyte, an unavoidable reaction with traces of air or moisture in the antechamber flooded with the inert gas will occur. These reaction products cannot be prevented from being deposited at unfavorable locations on the workpiece, which is to be aluminized and which was previously cleaned, as the workpiece is transported into the electroplating space through the liquid lock which acts both as a charging and discharging lock. Therefore, these parts can no longer be coated with technically usable aluminum coatings. In addition, since only a single workpiece holder can be introduced into the device at a time, the device is not suited for mass production of plated articles.

In an earlier patent application, U.S. Ser. No. 318,812, filed Nov. 6, 1981 and based on German patent application No. 3,044,975, a charging lock is provided for introducing of the workpiece holders or carriers and also a discharging lock is provided for allowing the removal of the workpiece holders containing the plated workpiece. In order to increase the amount of throughput, it is further proposed that the known electroplating tank be employed with an annular closed or isolated electroplating vat in which a multitude of workpiece holders can be simultaneously accommodated. For this reason, the electroplating tank contains a support device for the workpiece holders which both contacts and holds the workpiece holders. This device is rotatable around a vertical axis of rotation and has brackets for receiving each of the workpiece holders so that they are moved in a circular arc or path in a substantially horizontal plane. As a result of the annular design of the electrolyte bath or vat, the workpiece holders can be moved through the electrolyte in a circular path and by so doing can be coated with aluminum at a higher current density. This device has proven itself.

SUMMARY OF THE INVENTION

The present invention is directed to a device for electroplating aluminum from an aprotic, oxygen-free, water-free aluminum-organic electrolyte in such a manner that the output is increased and this increase in the output is relatively easily obtained. To obtain this object, the present invention is directed to an improvement in an electroplating tank having an annular vat containing the electrolyte and anode plates, a hood or cover closing or isolating the vat from the outside and forming a protective chamber over the electrolyte and having means for charging the chamber with a protective atmosphere, support means for contacting and holding a workpiece holder being disposed in the tank, said support means being rotatable around a vertical axis substantially on the axis of the vat and having a plurality of fork-shaped brackets extending radially from said axle in a horizontal plane, said brackets having receptacles for receiving horizontal rods of the workpiece holder to suspend the workpiece holder in the vat for rotation in a curved path, the tank including a first lock means for forming a charging lock for introducing workpiece holders from the tank without contaminating the protective atmosphere and second lock means for removing processed workpiece holders from the tank without contaminating the atmosphere, each of the lock means including a liquid lock and conveyor means for engaging the workpiece holder and passing them through the liquid lock during loading and unloading of the brackets of the support means. The improvements are that the vat is subdivided into a plurality of annular sub-cells which are concentrically arranged relative to one another, each bracket having receptacles for each sub-cell and the conveyor means of each of the lock means being designed to convey a workpiece holder for each of said sub-cells simultaneously through the lock means as the brackets of the support means are being loaded and unloaded.

By utilizing a plurality of sub-cells which are concentrically arranged relative to one another, the device can increase its output. For example, when using only two annular cells, the output is doubled. However, because many of the expensive parts such as the rotating parts for the support means are not increased in number, the outlay or cost of building the annular concentric cells does not rise nearly as much as the increase in output. In order to keep the standstill or dwell time for the rotary support means during loading and unloading as small as possible, it is desirable that the sub-cells are identically equipped as possible. This can be achieved by simultaneously introducing and removing the workpiece carriers or holders to each of the sub-cells through the respective charging and discharging lock. In order to achieve this advantage, it is desirable for the workpiece holders to be introduced into or respectively removed from the liquid locks of the charging or discharging locks through vertically extending introduction and removal shafts which are designed as antechambers. Thus, the workpiece holders can preferably be simultaneously delivered to the conveyor means of each of the liquid locks and conveyed through the liquid lock as a group with the number of the group corresponding to the number of sub-cells.

According to another additional design of the invention, each of the liquid locks and conveyor means therein are designed so that a plurality of groups of workpiece holders or carriers can be stored in the liquid lock.

Each of the lock means has a principal chamber which will extend from discharge openings of the liquid locks to closable entrance openings for the electroplating tank. Each of the principal chambers will have at least one horizontally movable main truck, which has vertically movable hooks for engaging holders positioned on the conveyor means of the liquid lock beneath the openings, to raise the holders from the liquid lock into the principal chamber. Then the truck or carriage will be shifted horizontally on horizontal rails to be brought over closed openings in the cover of the plating tank which closable openings are then opened and the holders are lowered by the hooks onto the forked arms of the bracket of the support means for suspension in the sub-cells.

It is desirable that the conveyor means in the principal chamber has a pair of closing plates. These closing plates have a size that is matched to the cross section of the principal chamber and prevent condensing electrolyte from entering into the liquid locks. It is desirable that these closing plates be suspended from individual trucks or carriages which also ride on the rails and can be coupled to the main carriage or truck of the conveyor means of the principal chamber by means of a magnetic clamp or coupling so that the closing plate can be moved between fixed locations which are determined by stops that are provided in the principal chamber.

In order to prevent the penetration of air and humidity into the introduction and removal shafts which serve as the antechambers of each of the lock means, it is expedient that these shafts be provided with means creating an air closure or curtain. This can be accomplished by providing each shaft with a nozzle ring, which blows warm air into the shaft and a second nozzle ring which is connected to a suction so that a continuous air current is achieved.

DESCRIPTION OF THE PREFERRED EMBODIMENTS

Figure 1A:
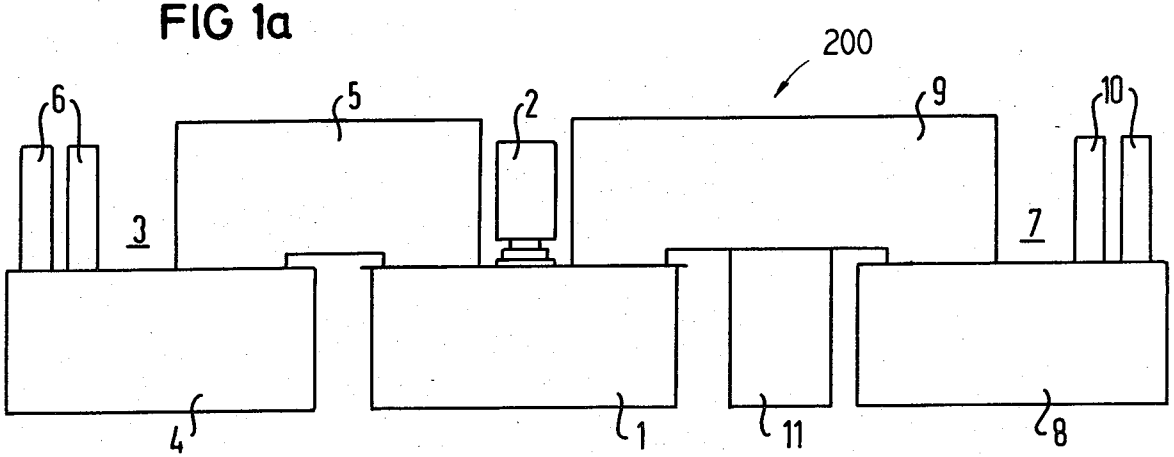
FIG. 1*a* is a side view of the device of the present invention.
Figure 1B:
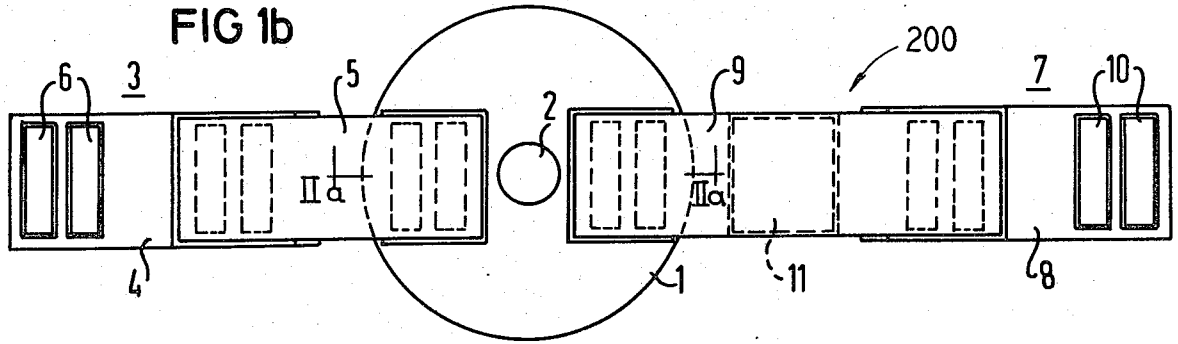
FIG. 1*b* is a top view of the device according to FIG. 1*a;*

The principles of the present invention are particularly useful in a device for electrodepositing of aluminum from an aprotic, oxygen-free and water-free aluminum-organic electrolyte which device is generally indicated 200 in FIGS. 1*a* and 1*b.*

The device 200 includes an electroplating tank 1 which has a pair of concentric sub-cells which have an angular configuration. Each of the sub-cells will function in a manner disclosed in the above-mentioned U.S. patent application Ser. No. 318,812. The tank 1 has a slip ring housing 2 on an upper portion. First lock means 3 which forms a charging lock includes a liquid lock 4 which is connected to the electroplating tank 1 by a principal chamber 5. In order to introduce workpiece holders or carries into the liquid lock 4, it is provided with vertically extending shafts 6 which form antechambers. To remove the processed workpiece holders from the electroplating tank 1, second lock means 7, which acts as a discharge lock, is provided and includes a liquid lock 8 which is connected to the electroplating tank 1 by a principal chamber 9 which serves as a gas lock. The workpiece holders are removed from the liquid lock 8 through vertically extending removal or discharge shafts 10 which are designed as antechambers. Since it is expedient to clean the adhering electrolyte from each of the workpiece holders as it is being removed from the electroplating tank 1, the second lock means 7 is illustrated as having a rinsing bath 11 provided in the principal chamber 9.

Since as illustrated in the FIGS. 1*a* and 1*b*, two introduction shafts 6 and two exit shafts 10 are provided in each of the lock means respectively, the electroplating tank 1 can be simultaneously loaded with two workpiece holders. This means a double of the output of the device such as disclosed in the above-mentioned earlier filed U.S. application. As illustrated in the Figures, the second lock means 7 forming the discharge lock is offset by 180° relative to the first lock means 3. It is entirely conceivable that the discharge lock 7 can be positioned at a different angle relative to the charging lock 3, for example, at an angle of 90° or 270°. All intermediate angles lying between these two angles are possible, however, a multiple of the angular space between two brackets of the support means is always preferable so that the electroplating tank can be both charged and emptied of the workpiece holders during a single standstill or dwell period of the rotatable support means.

Figure 2A:
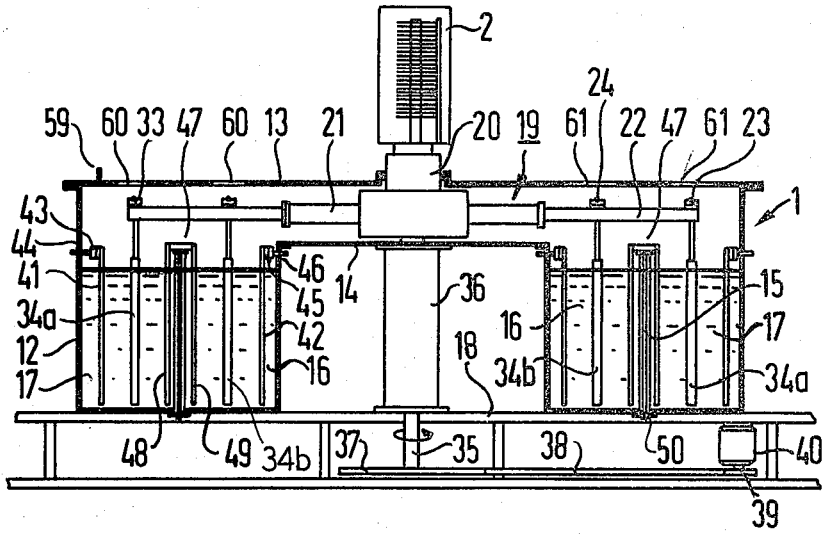
FIG. 2*a* is a cross-sectional view taken on line II*a*–II*a* of FIG. 1*b;*
Figure 2B:
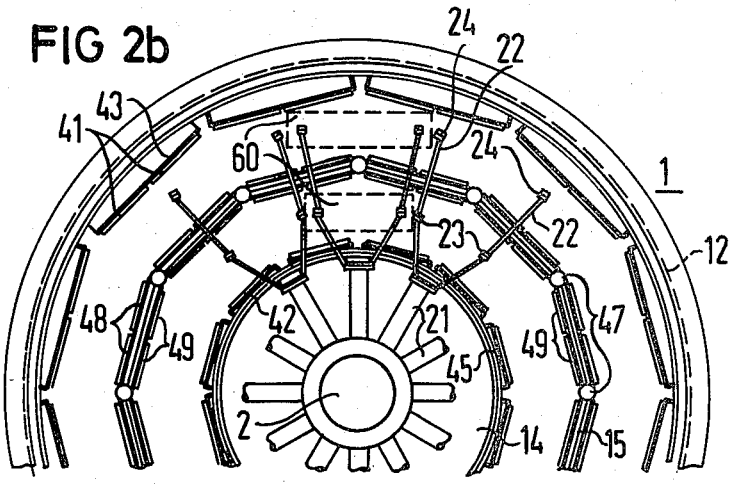
FIG. 2*b* is a partial plan view of the electroplating tank with the cover or hood removed.
Figure 4A:
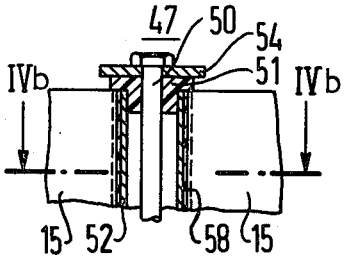
FIG. 4*a* is a partial cross-sectional view taken on line IVa—IVa of FIG. 3*a;*

The electroplating tank 1 is illustrated in an enlarged scale in FIGS. 2*a* and 2*b*, however, for the sake of illustration, only the details necessary for understanding the invention are illustrated. The electroplating tank consists of a circular electrolyte vat 12, which is designed to be dynamically balanced and has an outer annular wall connected to an inner annular wall by a bottom wall. As illustrated, the inner annular wall is lower than the outer annular wall and the vat is closed by an upper closing cover or load 13 which is connected to the upper edge of the outer annular wall and an inner closing cover 14 which is connected to the upper edge of the lower inner annular wall. The electrolyte vat 12 can be provided with corresponding external heating in a manner known per se. The electroplating vat 12 is subdivided by a plurality of enameled plates 15 into vat sub-cells 16 and 17 which are concentric relative to one another. As illustrated, the sub-cell 16 is the inside cell. The enameled plates 15 are disposed concentrically relative to the cylindrical inside and outside annular walls of the electroplating vat 12 as best shown in FIG. 2*b*.

Figure 5A:
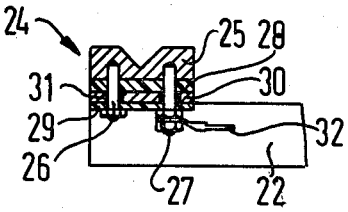
FIG. 5*a* is a cross-sectional view of a receptacle on a contact arm taken on line Va—Va of FIG. 5*b;*
Figure 5B:
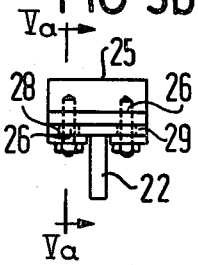
FIG. 5*b* is an end view of the contact arm according to FIG. 5*a;*

The vat 12 rests on a pedestal 18. As a result of the different heights of the outside and inside annular walls of the vat 12, a free space will exist between the upper closing cover 13 and the lower closing cover 14. This free space is provided for the rotatable support means 19 which consists of a rotor 20 which exhibits a total of 12 brackets 21 which are attached in a uniform angular disposition from the rotor 20 as illustrated in FIG. 2*b*. Each of these brackets 21 has two fork-shaped cathode arms 22 which are equipped with acceptance pieces or receptacles. As illustrated, the end of each arm has a receptacle 24 while a center or mid-portion of the arm has receptacles 23. Each of these receptacles or acceptance pieces are the same and FIGS. 5*a* and 5*b* illustrate one of the acceptance pieces 24 in greater detail. As illustrated, the piece consists of a contact couch or member 25, which is secured with the assistance of screws 26 and 27 on a carrier 30 of an arm 22. In order to insulate the member 25, an insulating piece 28 is interposed between the member 25 and the carrier 30 and an insulating piece 29 is interposed between the heads of the bolts 26 and 27 which bolts are provided with insulating sleeves 31 to insulate them from the carrier 30. The screw or bolt 26 provides a connection for a cathode line 32 which is conducted along the arm 22 through the bracket 21 to a corresponding slip ring in the slip ring housing 2. The contact member or couch 25 as illustrated has a V-shaped profile for receiving and supporting a contact rod 33 of a workpiece holder 34*a* (FIG. 2). In order to be able to maximally exploit the size of the baths of the cells, the workpiece holders 34 which are to be in the outer sub-cell 17 have a greater width than the workpiece holders 34*b* which are situated in the inner sub-cell 16. It also can be seen from FIG. 2*b* that the spacing between the pair of receptacles 23 of a single bracket is smaller than the spacing between the pair of receptacles 24.

The rotor 20 of the support means has a shaft 35, which is rotatably received in a pillar bearing 36 which is rigidly supported on the upper plate of the pedestal 18 and is secured to the lower closing cover 14. The lower end of the shaft 35 is provided with a chain wheel 37, which is connected to a motor pinion 39 of a motor 40 by a drive chain 38. It should be noted that the motor 40 is preferably an explosion-proof type motor. As already previously explained, each of the twelve brackets 21 and their pairs of forked cathode arms 22 exhibit a separate cathode line 32 which is connected to its respective slip ring which is mounted on the shaft 35 within the slip ring housing 2. The current conduction to the workpiece holders 34 is promoted by the triangular profile of each of the contact members or receptacles 25 which are mounted on the arms 22. The workpiece holders 34 themselves can consist of any of a type of frame in which the workpiece to be aluminum-plated can be secured, for example, with the assistance of electrical conducting holding wires. Thus, as a result of the rotary motion of the support means 19, the work-piece can be conducted through the electrolyte situated in an electrolyte vat 12 on a circular orbit or path.

Segment-like anode plates 41 and 42 are provided along the outer and inner walls of the vat 12 at an equal relative distance to the path of the workpiece holders 34*a* and 34*b*. Since the area of an arcuate segment along the outer wall is larger than the area of the same arcuate segment on the inner wall, two outer anode plates 41 are aligned with each inner anode plate 42. The two plates 41 are suspended from a common member or straps 43, whose ends are conducted out of the electrolyte bath 12 through insulated adapters 44. As already mentioned, each single plate 42 is suspended by a member or strap 44 whose ends are conducted out of the electroplating vat 12 through insulating adapters 46. The current is supplied to the outside and inside anode plates 41 and 42 in a standard manner, which is practiced in the electroplating technology such as by use of cables.

As already explained, the electrolyte vat 12 is subdivided into two annular sub-cells 16 and 17 and this subdivision occurs with the assistance of enameled plates 15 which are sealed to the bottom of the vat and are held with the assistance of columns 47 which also provide support for anode plates 48 and 49 which are located adjacent the plates 15 and are allocated to the anode plates 41 and 42. Like the anode plates 41, the anode plates 48 and 42 utilize two plates to cover the area assigned to each segment because a single plate would have too great a size and weight. The columns 47 are secured to the bottom wall or floor of the vat 12 with the assistance of tension bolts 50.

Figure 3A:
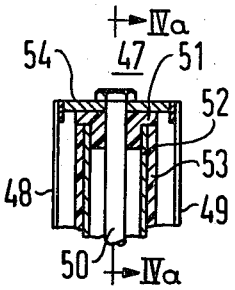
FIG. 3*a* is a partial cross-sectional view of a part of the anode mount.
Figure 3B:
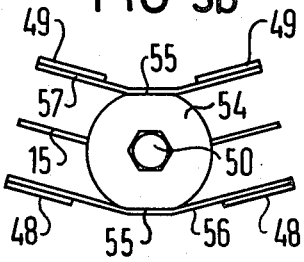
FIG. 3*b* is a top view of the mount of FIG. 3*a;*
Figure 4B:
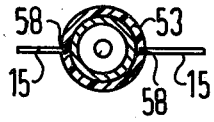
FIG. 4*b* is a cross-sectional view along the line IVb—IVb of FIG. 4*a;*

As best illustrated in FIGS. 3*a* and 3*b*, 4*a* and 4*b*, the columns 47 consist of a steel tube 52 which receives an insulating tube or sleeve 53 and serves as a space. The tube 52 is insulated from the tension bolt 50 by an insulating adapter 51 which is positioned both at the top and bottom of the column. It should be noted that the end of the tension bolt 50 simultaneously serves as an anode terminal and is in electrical contact with a disk 54. The disk 54 has a cutoff or beveled portion 55 on an opposite side and retaining straps 56 and 57, which consist of a conducting material, are secured to the disk 54 at the bevel 55 and provide means for suspension of the anode plates 48 and 49 as best illustrated in FIG. 3*b*. While the columns 47 serve for supporting the anode plates such as 48 and 49, they also serve for fastening of the enameled plates 51 which are inserted in grooves 58 provided in insulating sleeve or tube 53. Thus, the plates 15 not only divide the tank into the individual cells but also provide a mutual galvanic screen of the bath in one cell from the other cell.

In order to protect the oxygen-free and water-free aluminum-organic electrolyte, the electroplating tank 1 is charged with a dry protective atmosphere, for example, $N_2$, which, for example, is supplied to a nozzle 59 (FIG. *2a*) that is attached to the upper closing cover 13. The dry gas forming the protective atmosphere is metered into the tank in such a manner that a slight excess pressure always prevails. By so doing, the electroplating tank forms a protective chamber which is closed or isolated from the outside and charged with the protective atmosphere which protective chamber is only connected to the outside space through closable openings 60 and 61 which closable openings serve for the introduction and removal of workpiece holders 34*a* and 34*b*.

The charging lock formed by the first lock means 3 is connected to the closable openings 60 while the second lock means 7 forming the discharging lock are connected to the closable openings 61. As described with regard to FIGS. 1*a* and 1*b*, the lock means 3 and the lock means 7 have significant parts which include the liquid locks 4 and 8, respectively, which are illustrated in greater detail in FIGS. 8*a–c* and FIGS. 9*a–c*. The liquid lock 4 is connected to the closable openings 60 by the principal chamber 5 which is designed as a gas lock. As best illustrated in FIGS. 6*a–d*, the principal chamber 5 consists of a box-like structure 62 which is connected by a connection shaft 63 to the upper cover 13 of the tank 1 and is connected by a connection shaft 64 to a container of the liquid lock 4. This box-like structure 62 can also have a container part 65 for a toluol bath which would clean goods that are supported on the workpiece holders as the holders are being introduced into the electroplating tank 1. Since the articles and the workpiece holders are usually delivered clean, this container part 65 can be eliminated and as a result the length of the box-like structure 62 is correspondingly shortened.

A part of a conveyor means for the lock means 3 comprises providing a pair of parallel horozintally extending rails 66 which are secured with the assistance of spacers 67 on both sides of the outer wall of the upper part of the box-like structure 62. A bogey truck or main carriage 68, which has rollers or wheels 69 that are received on the rails 66 moves along the track formed by these two rails. A conveyor chain 70, which is connected around rollers or pulleys 71 and 72 is provided for moving the truck along the track formed by the rails 66. As illustrated, the roller 72 is secured to a drivable shaft 73 which can be rotated in either a counterclockwise or a clockwise direction as indicated by the arrow 74 and thus the truck 68 can be moved in both directions. A pair of chain wheels 77 are secured on a shaft 75 of the truck or carriage 68 and another set of chain wheels 78 are carried on a shaft 76. A pair of chains 79 extend over the chain wheels 77 and adjacent their free end are connected by a cross member 82. In a similar manner, a pair of chains 80 extend over the chain wheels 78 and have their free ends interconnected by a member 81. A pair of hooks 83 are secured to the member 81 while a pair of hooks 84 are secured to the member 82. As illustrated, the hooks 83 are carrying the workpiece holder 34*b* while the hooks 84 are carrying the workpiece holder 34*a*. The other end of each of the conveyor chains 79 and 80 is connected to the transport rollers 85 and 86, respectively, which, when rotated, cause the workpiece holders to be raised and lowered. The spacing of the shafts 75 and 86 on the truck 68 is selected so that the frames 34*a* and 34*b* can be simultaneously supplied to the electroplating tank and the charging of the electroplating tank with a pair of workpiece holders can occur. Since the workpiece holders 34*a* and 34*b* are transported into the position illustrated in FIGS. 6*a* and 6*b* by a drive device, these workpiece holders can execute oscillations which could complicate a precise location in the electroplating tank and difficulties in placing them on the particular receptacles such as 23 and 24. To prevent this oscillation, stays 87 (FIGS. 6*c* and 6d) are attached to the truck 68 and have guidance members such as 88 to engage the edges of the workpiece holders. It should be noted that the engagement of the workpiece holders by the stays 87 and the guidance members is only illustrated in FIGS. 6*c* and 6*d*.

Figure 8A:
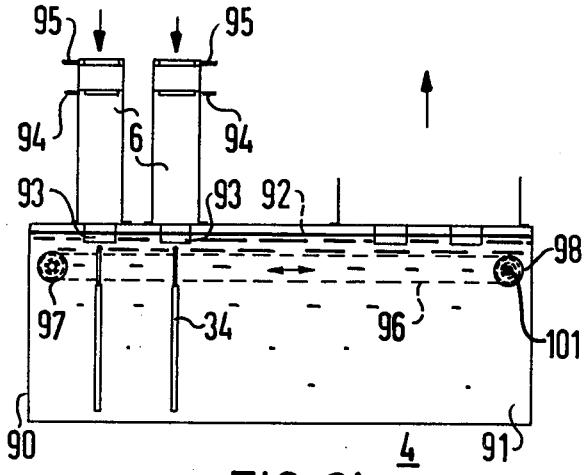
FIG. 8*a* is a longitudinal cross-sectional view of the liquid lock with introduction shafts of the charging lock according to FIG. 1*a;*
Figure 8C:
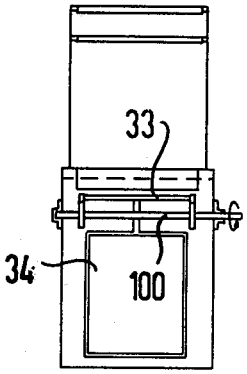
FIG. 8*c* is an end view with portions broken away of the liquid lock of FIG. 8*a;*
Figure 8B:
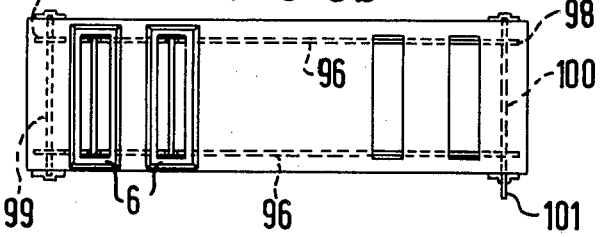
FIG. 8*b* is a plan view of the liquid lock according to FIG. 8*a;*
Figure 9A:
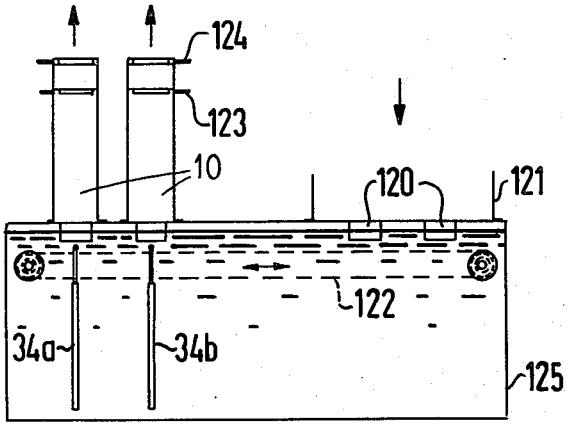
FIG. 9*a* is a longitudinal cross-sectional view of the liquid lock with the removal shafts of the discharging lock according to FIG. 1*b;*
Figure 9C:
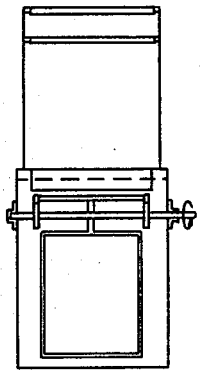
FIG. 9*c* is an end view with portions broken away of the liquid lock of FIG. 9*a.*
Figure 9B:
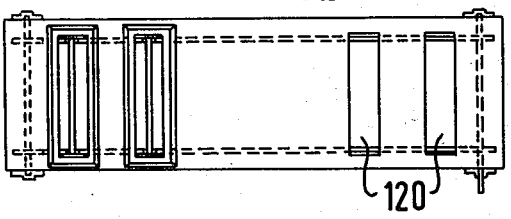
FIG. 9*b* is a plan view of the liquid lock according to FIG. 9*a;*.

The liquid lock 4 is best illustrated in FIGS. 8*a–8c* and has a container tank 90 which is closed on all sides which contains a liquid 91, for example, toluol. The level of the liquid 91 is indicated by the broken line 92. In order to form a liquid lock, the introduction shafts 6 extend vertically from an upper portion of the container 90 and have an extension or nozzle 93 which dips below the surface level 92 of the liquid 91. Thus, the level 92 of liquid must always be controlled in such a manner that the openings of the extensions 93 never emerge above the surface of the liquid level. Each of the introduction shafts 6 is provided with a nozzle ring 94 through which warm air is blown into the interior of the ring. A corresponding nozzle ring 95 is provided above the ring 94 and is provided with a suction so that an air curtain is created to close the upper end of the shaft 6. By so doing, the outside air and thus the humidity as well, are kept away from the interior of the introduction shaft 6. The space in the container 90, which is above the level 92 of the liquid as well as the remaining portion of the shafts 6 are kept under a protective atmosphere which is formed by nitrogen.

Figures 6A, 6B, 6C, 6D:
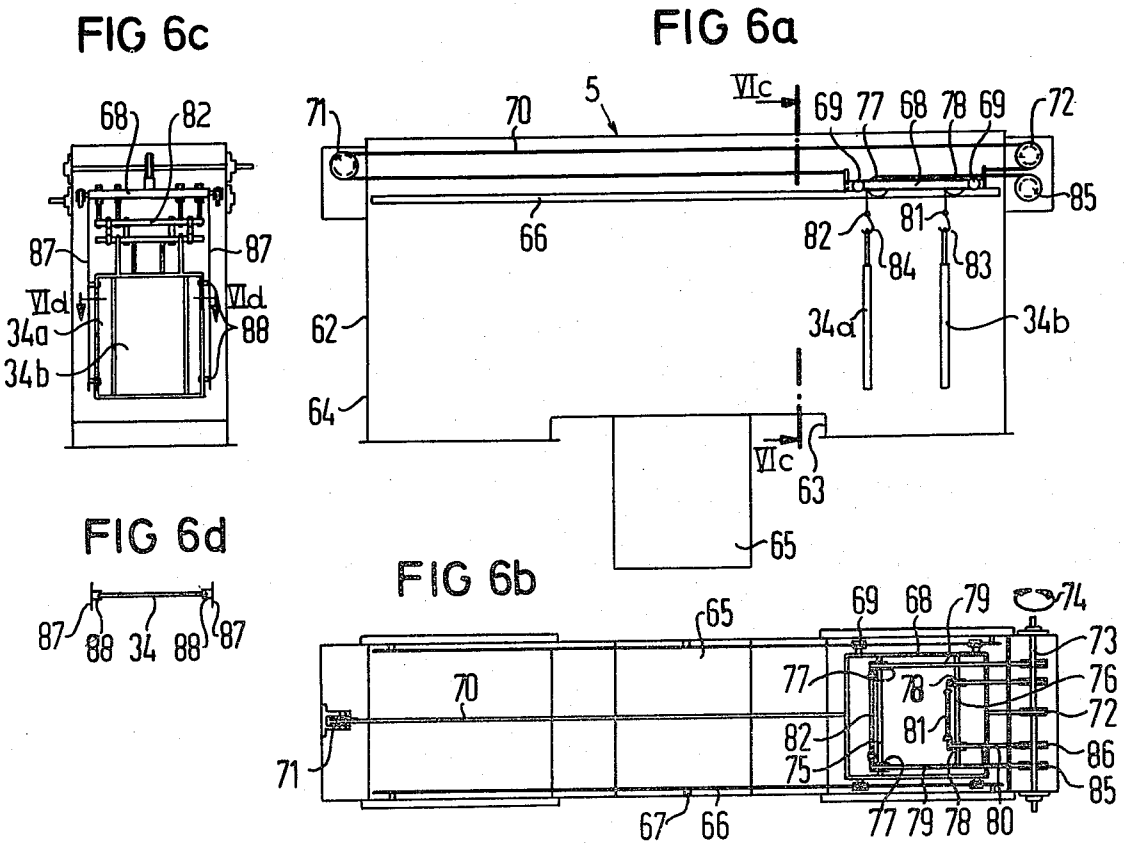
FIG. 6*a* is a longitudinal cross-sectional view of a principal chamber connected to the charging lock.
FIG. 6*b* is a plan view of the principal chamber according to FIG. 6*a;*
FIG. 6*c* is a view taken on line VIc—VIc of FIG. 6*a;*
FIG. 6*d* is a partial view tkane on line VId—VId of FIG. 6*c;*

The container 90 contains a portion of the conveyor means which includes an endless conveyor chain 96 which is passed over chain wheels 97 and 98 which are provided in the container. The chain wheels 97 and 98 are secured to shafts 99 and 100 which are mounted for rotation in the walls of the container 90 and the shaft 100 has a portion extending through a seal 101 so that it can be a driven shaft. Usually it is sufficient if the shaft 100 is driven to rotate in only one direction because the conveyor chains 96 are endless. However, under certain conditions, such as when the workpiece holders 34 are to be removed through the lock 3, it is then necessary that the shaft 100 be rotated in both directions. In this case, the principal chamber 5 as illustrated in FIGS. 6*a* and 6*b* has the washing bath 65 and the lock means 3 acts as both a charging lock as well as a discharging lock which enables reducing the cost of the device. It should be noted that in such an arrangement, the closable openings 61 in the upper cover 13 remain closed. An advantage of this embodiment is that the space required for erecting the device 200 will be considerably less than what is required when you have both a separate charging lock and separate discharging lock. The contamination of the liquid lock 4, when utilizing it both for charging and discharging, is avoided because the container part 65 for the toluol bath is provided so that the electrolyte still adhering to the workpiece holders and workpiece can be eliminated from the goods. On the other hand, the charging of the goods or the workpiece holders 34 can occur without utilizing a toluol bath because these workpiece holders and the workpieces supported therein have been previously cleaned.

As best illustrated in FIGS. *7a–d*, the principal chamber 9 for the second lock means 7 is essentially the same structure as the principal chamber 5. However, as illustrated in the FIGS. *7a–d*, a few structural details are different. For example, the principal chamber 9 has a housing 102 which is formed of a structural rack 103 covered with material and a container 104 containing a toluol rinse bath is suspended and secured in a gas-tight relationship from a position 105. In the chamber 9, a main truck or carriage 106 which is designed in the same manner as the truck 68 according to FIG. 6 is connected by an iron tie 107 to a roller 108 and the other end of the truck is connected by an iron tie or cable to a roller 109. Hooks 110 and 111 for the removal of the workpiece holders **34*a* and 34*b* are likewise actuated in a similar manner as the hooks 83 and 84**.

Figures 7A, 7B, 7C, 7D:
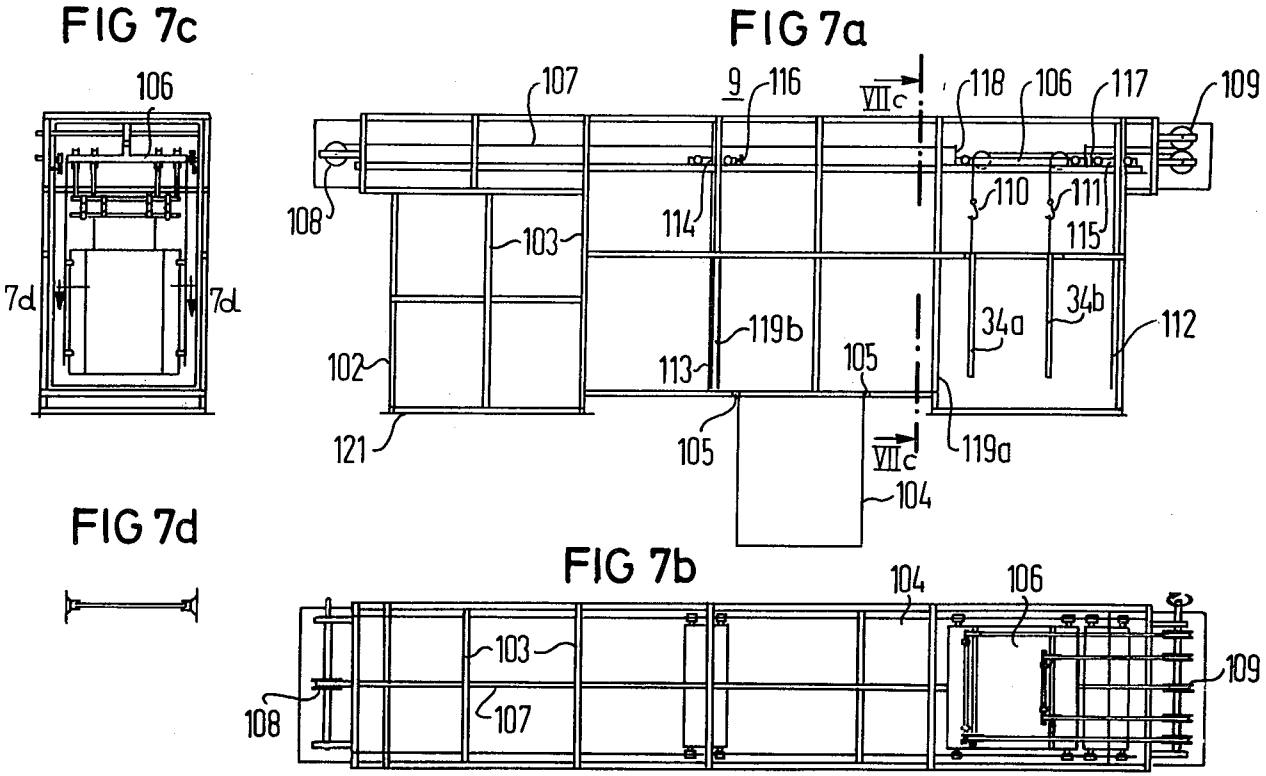
FIG. 7*a* is a longitudinal cross-sectional view of the principal chamber connected to the discharging lock.
FIG. 7*b* is a plan view of the principal chamber according to FIG. 7*a;*
FIG. 7*c* is a view taken from line VIIc—VIIc of FIG. 7*a;*
FIG. 7*d* is a partial detail view taken on line 7*d*–7*d* of FIG. 7*c;*

In addition to operating on the same principle as the chamber 5 of the charging lock 3, the principal chamber 9 has two closing plates 112 and 113, which are mounted on additional trucks 115 and 14 respectively. These plates 112 and 113 have the dimensions to clear the inside space of the housing 102 and serve the purpose of keeping the electrolyte vapors from the electroplating tank from entering the liquid lock 8. These vapors will condense as a result of relatively large size of the housing 102 of the principal chamber 9 or the housing 62 of the principal chamber 5. Since the closing plates 112 and 113 can be moved together with the truck 106, they are provided as perforated plates in order to reduce their air resistance. The trucks 114 and 115 on their side facing the main truck 106 are provided with magnetic clamps 116 and 117 which interact with the soft iron block 118 disposed on each end of the main truck 106. In the position illustrated in FIG. *7a*, the truck 115 of the closing plate 112 is coupled to the truck 106. When the truck 106 is shifted to the left as illustrated in FIG. 7, the closing plate 112 will be carried along until it strikes against a stop frame **119*a* which prevents further movement and retains it in that position. The frame 103 has a stop plate 119*b* which prevents movement of the plate 113 and its carriage 114** toward the right-hand side of the Figure.

As illustrated in FIG. *7a*, the workpiece holders **34*a* and 34*b* have just been raised from the electroplating tank 1. In this position, the truck 106 will be moved to the left and due to the magnetic coupling 117, the truck 115 with the plate 112 will move therewith. When the plate 112 reaches or engages the stop member 119*a*, its further movement is prevented. At this position, the workpiece holders 34*a* and 34*b* can be lowered into a toluol rinse bath situated in the container 104. After cleaning, the goods are again raised up and moved further to the left as illustrated in the drawing and the soft iron plate 118 on the truck 106 will form a connection with the magnetic clamp 116 of truck 114. The truck 114, which carries the plate 113, will move with the truck 106 until the truck 106 is in a position to discharge the workpiece holders through the openings 120** (FIG. *9a*) of the liquid lock 8. The principal chamber 9 has a connecting shaft 121 which surrounds the discharge openings 120.

As best illustrated in FIGS. *9a–c*, the liquid lock 8 has a container 125 and is substantially the same structure as the liquid lock 3. As the workpiece holders such as **34*a* and 34*b* are passed through the openings 120, they are received by an endless conveyor chain 122 and transported in a horizontal direction beneath the shafts 10, which also have an end that extends below the liquid level in the container 125 of the liquid lock. As in the liquid lock 3, each of the shafts 10 has a nozzle ring 123 which blows in warm air and a ring 124 which has a suction to form an air curtain to close the end of the shaft. The remaining portion of each of the shafts 10 contains a nitrogen atmosphere just like the portion of the container 105** above the liquid level.

The conveying means such as the chain 122 of the liquid lock 8 as well as the conveying means of the liquid lock 4 are designed in such a manner that a plurality of groups of the workpiece holders 34 can be simultaneously stored thereon. Thus, the required supply of workpiece holders is always present in each of the liquid locks during operation of the device.

Although various minor modifications may be suggested by those versed in the art, it should be understood that we wish to embody within the scope of the patent granted hereon, all such modifications as reasonably and properly come within the scope of our contribution to the art.

We claim:

1. In a device for electrodepositing of aluminum from an aprotic, oxygen-free and water-free aluminum electrolyte, said device comprising an electroplating tank having an annular vat containing the electrolyte and anode plates, a hood closing the vat from the outside, forming a protective chamber over the electrolyte and having means for charging the chamber with a protective atmosphere, support means for contacting and holding a workpiece holder being disposed in the tank, said support means being rotatable around a vertical axle and having a plurality of fork-shaped brackets extending radially from said axle in a horizontal plane, said brackets having receptacles for receiving horizontal rods of the workpiece holders to suspend the workpiece holder in the vat for rotation in a curved path, said tank including a first lock means for forming a charging lock for introducing workpiece holders into the tank without contaminating the protective atmosphere, and second lock means for removing processed workpiece holders from the tank without contaminating the protective atmosphere, each of said lock means including a liquid lock and conveyor means for engaging the workpiece holders and passing them through the liquid lock during loading and unloading of the brackets of the support means, the improvements comprising the vat being subdivided into a plurality of annular sub-cells concentrically arranged relative to one another, each bracket having receptacles for each sub-cell and the conveyor means of each of the lock means being designed to convey a workpiece holder for each of said sub-cells simultaneously through the lock means as the brackets of the support means are being loaded and unloaded.

2. In a device according to claim 1, wherein each of the liquid locks of the lock means comprises a container containing the liquid, said container having a discharge opening for each of said sub-cells in communication with a principal chamber, said container of the liquid lock having a vertical shaft for each of said sub-cells extending vertically from an upper wall of the container, each of said shafts having a lower portion extending below the surface of the liquid in the container, a portion of the conveyor means of the lock means being disposed in the container beneath said liquid for transferring the workpiece holders between the discharge openings and the vertical shafts.

3. In a device according to claim 2, wherein the conveyor means in each of the liquid locks is dimensioned in such a manner as to enable storing a plurality of workpiece holders in the desired space relationship therein.

4. In a device according to claim 2, wherein each of the vertical shafts includes a nozzle ring connected to a suction source.

5. In a device according to claim 4, wherein each of the shafts includes a second nozzle ring connected to a source of pressurized warm air, said second nozzle ring and said first-mentioned nozzle ring coacting to form an air curtain means for sealing the shaft opening.

6. In a device according to claim 2, wherein the conveyor means of each liquid lock include the principal chamber having a truck horizontally movable on horizontal rails from a position over the discharge openings of the liquid lock to a position over closable openings extending out of the electroplating tank, said truck having vertically movable hooks for engaging workpiece holders and moving them through the closable openings of the electroplating tank and of the liquid lock during movement of the workpiece holders between said tank and liquid lock.

7. In a device according to claim 6, wherein the principal chamber includes a pair of closing plates mounted on movable carriages riding on the rails of said truck, each of said plates having a contour matching the cross section of the interior of the principal chamber, and said truck having a means for coupling the truck to each of said carriages.

8. In a device according to claim 7, wherein each of the closing plates is a perforated plate.

9. In a device according to claim 7, wherein the means for coupling comprises a magnetic clamp clamping the truck to the carriage.

10. In a device according to claim 9, wherein the principal chamber has a frame provided with stop means for each of said closing plates, said closing plates when engaging said stop means being arrested in movement along with the carriage so that the magnetic force forming the magnetic clamp is overcome.

11. In a device according to claim 1, wherein the second lock means includes a washing cell positioned to receive the workpiece holders prior to the workpiece holders being inserted in the liquid lock of said second lock means.

* * * * *